US011605349B2

(12) United States Patent
Tang et al.

(10) Patent No.: US 11,605,349 B2
(45) Date of Patent: Mar. 14, 2023

(54) DISPLAY PANEL HAVING A RESET CONTROL CIRCUIT

(71) Applicant: Wuhan Tianma Micro-Electronics Co., Ltd., Wuhan (CN)

(72) Inventors: Shuo Tang, Wuhan (CN); Zhihua Yu, Wuhan (CN); Jun Li, Wuhan (CN)

(73) Assignee: Wuhan Tianma Micro-Electronics Co., Ltd., Wuhan (CN)

( * ) Notice: Subject to any disclaimer, the term of this patent is extended or adjusted under 35 U.S.C. 154(b) by 0 days.

(21) Appl. No.: 17/527,418

(22) Filed: Nov. 16, 2021

(65) Prior Publication Data

US 2022/0076632 A1 Mar. 10, 2022

(30) Foreign Application Priority Data

Aug. 12, 2021 (CN) ..... 202110926449.0

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01); *G09G 2300/0426* (2013.01); *G09G 2310/0278* (2013.01); *G09G 2310/061* (2013.01)

(58) Field of Classification Search
CPC ..... G09G 3/3258
USPC ..... 345/84
See application file for complete search history.

(56) References Cited

U.S. PATENT DOCUMENTS

2019/0096327 A1* 3/2019 Peng ..... G09G 3/3233
2021/0193036 A1* 6/2021 Huang ..... G09G 3/3233

FOREIGN PATENT DOCUMENTS

CN 107610652 A 1/2018
CN 110910835 A 3/2020
CN 111276084 A 6/2020
CN 111754922 A 10/2020

* cited by examiner

*Primary Examiner* — Long D Pham
(74) *Attorney, Agent, or Firm* — KDB Firm PLLC

(57) ABSTRACT

Provided are a display panel and a display device. The display panel includes a pixel driving circuit and a reset control circuit. The pixel driving circuit includes a light-emitting element, a first reset module, a first control module, a data write module, a driving transistor, a second reset module and a second control module. In the initial reset stage of the pixel driving circuit, the reset control circuit is configured to control the first reset module to turn on and apply a reset voltage of the reset voltage terminal to the first electrode of the light-emitting element, and the first scan signal terminal is configured to control the second reset module to turn on and apply the reset voltage to the gate of the driving transistor.

18 Claims, 14 Drawing Sheets

DISPLAY PANEL HAVING A RESET CONTROL CIRCUIT

CROSS-REFERENCE TO RELATED APPLICATION

This application claims priority to Chinese Patent Application No. 202110926449.0 filed Aug. 12, 2021, the disclosure of which is incorporated herein by reference in its entirety.

FIELD

The present disclosure relates to the field of display technology and, in particular, to a display panel and a display device.

BACKGROUND

Organic light-emitting diode (OLED) display panels are one of the hotspots in the research field of flat display panels currently. Compared with liquid crystal display (LCD) panels, OLED display panels have the advantages of low energy consumption, low production cost, self-luminescence, wide viewing angle and fast response speed. At present, OLED display panels have begun to replace traditional LCD panels in the display field such as mobile phones, tablet computers and digital cameras.

However, with the continuous development of display technology, the refresh rate of an OLED display panel is getting higher and higher. For OLED display panels of the same size, the higher the refresh rate of an OLED display panel is, the shorter the time for scanning one frame of image is, and the shorter the duration for scanning one row of pixels. In this manner, the reset time of a light-emitting element is relatively short, resulting in an insufficient reset and undesired light emission in the case of a low grayscale.

SUMMARY

The present disclosure provides a display panel and a display device.

In a first aspect, embodiments of the present disclosure provide a display panel that includes a pixel driving circuit and a reset control circuit.

The pixel driving circuit includes a light-emitting element, a first reset module, a first control module, a data write module, a driving transistor, a second reset module, a second control module. A control terminal of the first reset module is electrically connected to an output terminal of the reset control circuit, a first terminal of the first reset module is electrically connected to a reset voltage terminal, a second terminal of the first reset module is electrically connected to a first electrode of the light-emitting element, and a second electrode of the light-emitting element is electrically connected to a first constant voltage terminal. A control terminal of the second reset module is electrically connected to a first scan signal terminal, a first terminal of the second reset module is electrically connected to the reset voltage terminal, and a second terminal of the second reset module is electrically connected to a gate of the driving transistor. A control terminal of the data write module is electrically connected to a second scan signal terminal, a first terminal of the data write module is electrically connected to a data signal terminal, and a second terminal of the data write module is electrically connected to a first electrode of the driving transistor. A control terminal of the first control module is electrically connected to a light emission signal terminal, a first terminal of the first control module is electrically connected to a second constant voltage terminal, and a second terminal of the first control module is electrically connected to the first electrode of the driving transistor. A control terminal of the second control module is electrically connected to the light emission signal terminal, a first terminal of the second control module is electrically connected to a second electrode of the driving transistor, and a second terminal of the second control module is electrically connected to the first electrode of the light-emitting element.

In an initial reset stage of the pixel driving circuit, the reset control circuit is configured to control the first reset module to be turned on and apply a reset voltage of the reset voltage terminal to the first electrode of the light-emitting element, and the first scan signal terminal is configured to control the second reset module to be turned on and apply the reset voltage to the gate of the driving transistor.

In a data write stage of the pixel driving circuit, the reset control circuit is configured to control the first reset module to be turned on and apply the reset voltage to the first electrode of the light-emitting element, and the second scan signal terminal is configured to control the data write module to be turned on and write a data signal of the data signal terminal to the gate of the driving transistor.

In a second aspect, embodiments of the present disclosure provide a display device that includes the display panel described in the first aspect.

DETAILED DESCRIPTION

Figure 1:
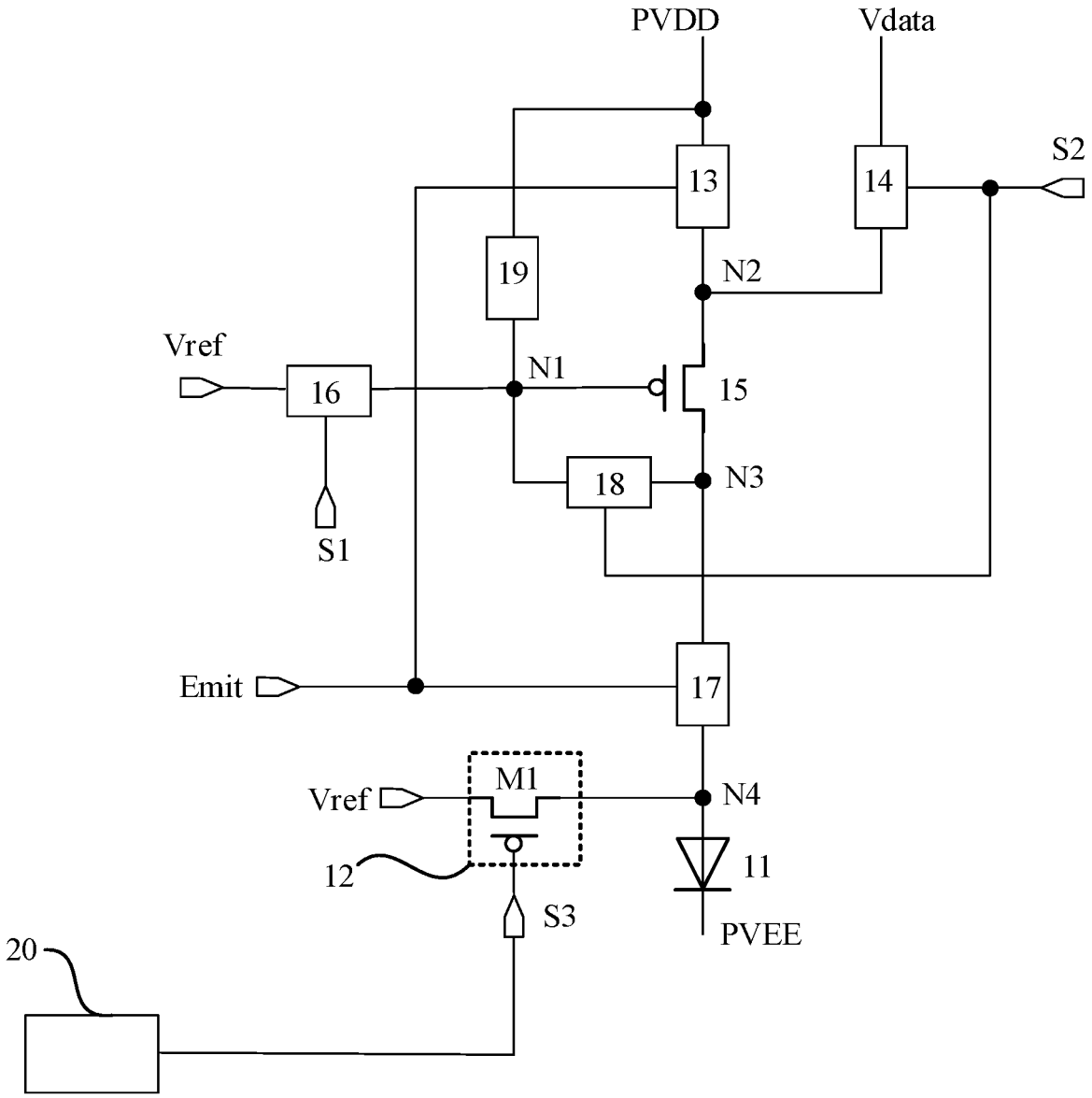
FIG. 1 is a circuit diagram of a display panel according to embodiments of the present disclosure.

The present disclosure is further described hereinafter in detail in conjunction with drawings and embodiments. It is to be understood that the embodiments described herein are intended to illustrate and not to limit the present disclosure. Additionally, it is to be noted that for ease of description, only part, not all, of the structures related to the present disclosure are illustrated in the drawings.

Figure 2:
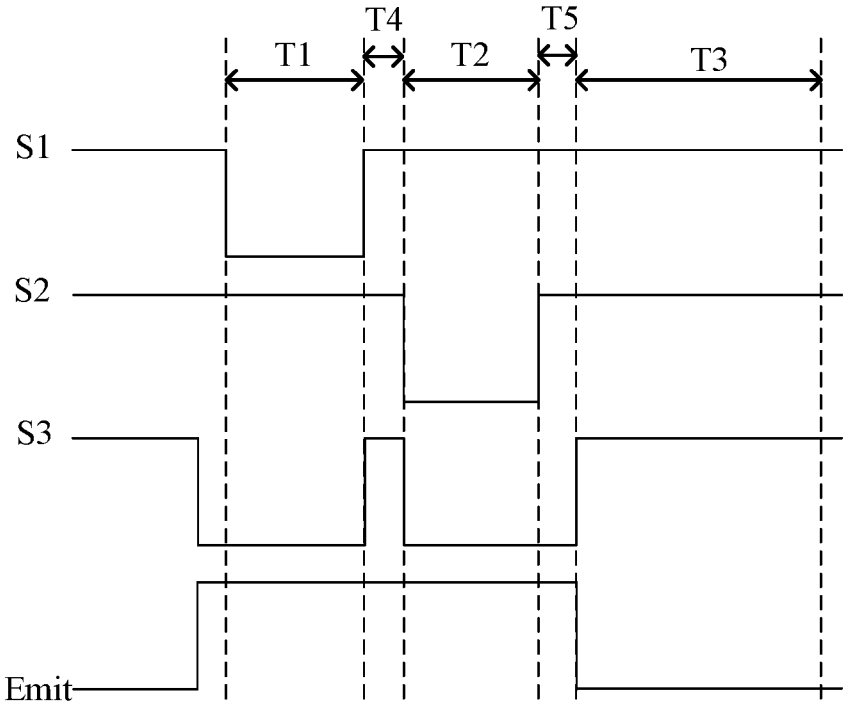
FIG. 2 is a timing diagram of a pixel driving circuit according to embodiments of the present disclosure.

FIG. 1 is a circuit diagram of a display panel according to embodiments of the present disclosure, and FIG. 2 is a timing diagram of a pixel driving circuit according to embodiments of the present disclosure. Referring to FIGS. 1 and 2, the display panel includes a pixel driving circuit 10 and a reset control circuit 20. The pixel driving circuit 10 includes a light-emitting element 11, a first reset module 12, a first control module 13, a data write module 14, a driving transistor 15, a second reset module 16 and a second control module 17. A control terminal of the first reset module 12 is electrically connected to an output terminal S3 of the reset control circuit, a first terminal of the first reset module 12 is electrically connected to a reset voltage terminal Vref, and a second terminal of the first reset module 12 is electrically connected to a first electrode of the light-emitting element 11. A second electrode of the light-emitting element 11 is electrically connected to a first constant voltage terminal PVEE. A control terminal of the second reset module 16 is electrically connected to a first scan signal terminal S1, a first terminal of the second reset module 16 is electrically connected to the reset voltage terminal Vref, and a second terminal of the second reset module 16 is electrically connected to a gate of the driving transistor 15. A control terminal of the data write module 14 is electrically connected to a second scan signal terminal S2, a first terminal of the data write module 14 is electrically connected to a data signal terminal Vdata, and a second terminal of the data write module 14 is electrically connected to a first electrode of the driving transistor 15. A control terminal of the first control module 13 is electrically connected to a light emission signal terminal Emit, a first terminal of the first control module 13 is electrically connected to a second constant voltage terminal PVDD, and a second terminal of the first control module 13 is electrically connected to the first electrode of the driving transistor 15. A control terminal of the second control module 17 is electrically connected to the light emission signal terminal Emit, a first terminal of the second control module 17 is electrically connected to a second electrode of the driving transistor 15, and a second terminal of the second control module 17 is electrically connected to the first electrode of the light-emitting element 11.

In an initial reset stage T1 of the pixel driving circuit 10, the reset control circuit 20 is configured to control the first reset module 12 to be turned on and apply a reset voltage of the reset voltage terminal Vref to the first electrode of the light-emitting element 11 so as to reset the first electrode of the light-emitting element 11 for the first time (that is to reset the light-emitting element 11). The first scan signal terminal S1 is configured to control the second reset module 16 to be turned on and apply a reset voltage of the reset voltage terminal Vref to the gate of the driving transistor 15 so as to reset the gate of the driving transistor 15. The reset voltage applied to the gate of the driving transistor 15 may be the same as or different than the reset voltage applied to the first electrode of the light-emitting element 11. That is, the voltage of the reset voltage terminal electrically connected to the first terminal of the first reset module 12 may be different than the voltage of the reset voltage terminal electrically connected to the first terminal of the second reset module 16. In a data write stage T2 of the pixel driving circuit 10, the reset control circuit 20 is configured to control the first reset module 12 to be turned on and apply a reset voltage of the reset voltage terminal Vref to the first electrode of the light-emitting element 11 so as to reset the first electrode of the light-emitting element 11 for the second time. The second scan signal terminal S2 is configured to control the data write module 14 to be turned on and write a data signal of the data signal terminal Vdata to the gate of the driving transistor 15.

Embodiments of the present disclosure provide a display panel that includes the pixel driving circuit 10 and the reset control circuit 20. The pixel driving circuit 10 includes the first reset module 12 and the light-emitting element 11. The first terminal of the first reset module 12 is electrically connected to the reset voltage terminal Vref, and the second terminal of the first reset module 12 is electrically connected to the first electrode of the light-emitting element 11. In the initial reset stage T1 and the data write stage T2 of the pixel driving circuit 10, the reset control circuit 20 is configured to control the first reset module 12 to be turned on and apply a reset voltage of the reset voltage terminal Vref to the first electrode of the light-emitting element 11 so as to increase the reset time of the light-emitting element 11 and alleviate the problem of undesired light emission in the case of a low grayscale and a high frequency.

Figure 3:
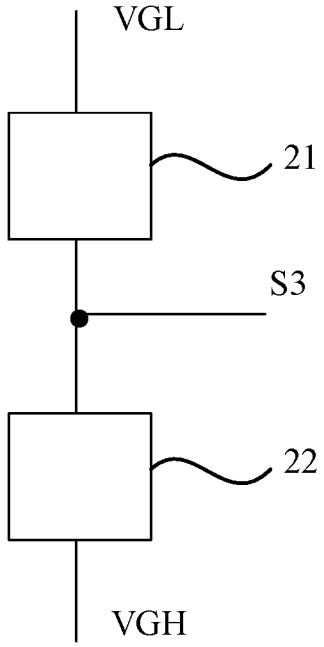
FIG. 3 is a circuit diagram of a reset control circuit according to embodiments of the present disclosure.

FIG. 3 is a circuit diagram of a reset control circuit according to embodiments of the present disclosure. Referring to FIG. 3, the reset control circuit 20 includes a first reset control module 21 and a second reset control module 22. A first terminal of the first reset control module 21 is electrically connected to a first voltage signal terminal VGL, a second terminal of the first reset control module 21 is electrically connected to the output terminal S3 of the reset control circuit, and the first reset control module 21 is configured to control the first reset module 12 to be turned on to apply a reset voltage of the reset voltage terminal Vref to the first electrode of the light-emitting element 11 so as to reset the first electrode of the light-emitting element 11. A first terminal of the second reset control module 22 is electrically connected to a second voltage signal terminal VGH, a second terminal of the second reset control module 22 is electrically connected to the output terminal S3 of the reset control circuit, and the second reset control module 22 is configured to control the first reset module 12 to be turned off. In the embodiments of the present disclosure, the first reset control module 21 is configured to control the first reset module 12 to be turned on when the first reset control module 21 transmits a voltage of the first voltage signal terminal VGL to the output terminal S3 of the reset control circuit, and the second reset control module 22 is configured to control the first reset module 12 to be turned off when the second reset control module 22 transmits a voltage of the second voltage signal terminal VGH to the output terminal S3 of the reset control circuit.

It can be understood that the first reset control module 21 and the second reset control module 22 may include one or a plurality of transistors to control the electrical signal transmission according to timing. The transistors are divided into N-type transistors and P-type transistors. The N-type transistor is turned on at a high level and turn off at a low level, that is, the enable level of the N-type transistor is at a high level, and the non-enable level of the N-type transistor is at a low level. The P-type transistor is turned off at a high level and turned on at a low level, that is, the enable level of the P-type transistor is at a low level, and the non-enable level of the P-type transistor is at a high level. For simplicity, the P-type transistor is used as an example in each embodiment of the present disclosure, but the present disclosure is not limited to the preceding.

It is to be noted that the timing diagram shown in FIG. 2 illustrates the charging and discharging situations in an ideal state. That is, the voltage change is completed instantaneously, and the slopes of the rising edge and falling edge are 90°. In the display panel in practice, the charging and discharging of each element are not completed instantaneously, and a certain charging and discharging time always exists. The voltage changes gradually, and the slopes of the rising edge and the falling edge are less than 90°. Therefore, a certain margin is necessarily disposed after the initial reset stage T1, that is, a time interval is disposed between the initial reset stage T1 and the data write stage T2 to avoid overlapping the initial reset stage T1 with the data write stage T2. Similarly, a time interval may be further disposed between the data write stage T2 and a light emission stage T3 to avoid overlapping the data write stage T2 with the light emission stage T3.

In an embodiment, referring to FIGS. 1 to 3, the second reset control module 22 is configured to control the output terminal S3 of the reset control circuit to be at a high level and the first reset module 12 to be turned off in a stage (denoted as stage T4) between the initial reset stage T1 and the data write stage T2. In the stage T4, the first reset control module 21 cannot transmit a voltage of the first voltage signal terminal VGL to the output terminal S3 of the reset control circuit. If the second reset control module 22 is not disposed, the output terminal S3 of the reset control circuit has no voltage input, so the voltage of the output terminal S3 of the reset control circuit is indefinite. As a result, the input voltage of the control terminal of the first reset module 12 is indefinite, and the control terminal of the first reset module 12 is vulnerable to the external electromagnetic interference and destroys the normal logical relationship, for example, destroying the normal turn-on and turn-off timing. With the configuration of disposing the second reset control module 22 in the embodiments of the present disclosure, the second reset control module 22 transmits a voltage of the second voltage signal terminal VGH to the output terminal S3 of the reset control circuit to avoid the voltage indefiniteness of the output terminal S3 of the reset control circuit. In other embodiments, in the stage T4, the second reset control module 22 is configured to control the first reset module 12 to be turned on, and the first reset control module 21 transmits a voltage of the first voltage signal terminal VGL to the output terminal S3 of the reset control circuit, which may also avoid the voltage indefiniteness of the output terminal S3 of the reset control circuit. Additionally, it is to be noted that in other embodiments, the second reset control module 22 is configured to control the first reset module 12 to be turned off when being configured to control the output terminal S3 of the reset control circuit to be at a low level. That is, the present disclosure does not limit the enable level for controlling the first reset module 12 to be turned on, and the enable level may be at a high level or low level.

Figure 4:
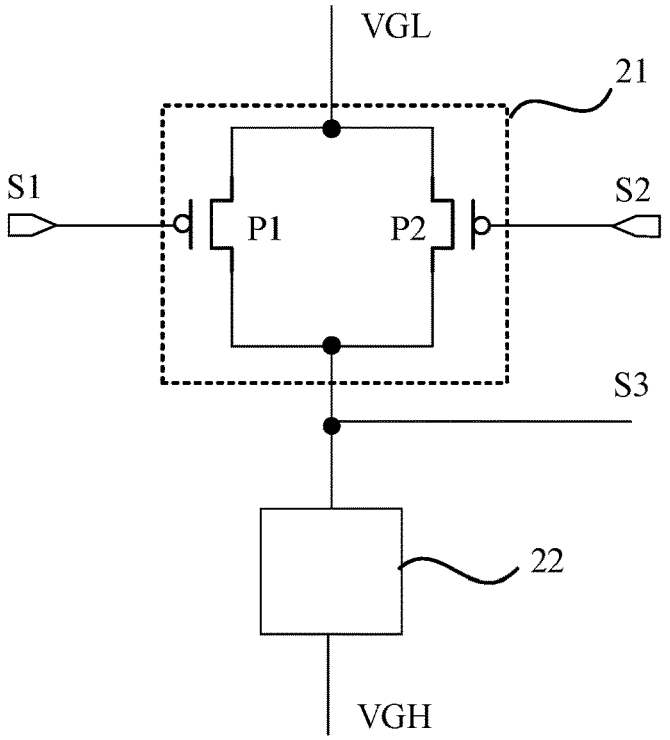
FIG. 4 is a circuit diagram of another reset control circuit according to embodiments of the present disclosure.

FIG. 4 is a circuit diagram of another reset control circuit according to embodiments of the present disclosure. Referring to FIG. 4, the first reset control module 21 includes a first switch transistor P1 and a second transistor P2. A gate of the first switch transistor P1 is electrically connected to the first scan signal terminal S1, a first electrode of the first switch transistor P1 is electrically connected to the first voltage signal terminal VGL, and a second electrode of the first switch transistor P1 is electrically connected to the output terminal S3 of the reset control circuit. A gate of the second switch transistor P2 is electrically connected to the second scan signal terminal S2, a first electrode of the second switch transistor P2 is electrically connected to the first voltage signal terminal VGL, and a second electrode of the second switch transistor P2 is electrically connected to the output terminal S3 of the reset control circuit.

Referring to FIGS. 2 and 4, the first switch transistor P1 and the second transistor P2 are taken as P-type transistors for example. In the initial reset stage T1 of the pixel driving circuit 10, the first scan signal terminal S1 is at a low level, so the first switch transistor P1 is turned on under the control of a low-level signal of the first scan signal terminal S1 and transmits a voltage of the first voltage signal terminal VGL to the output terminal S3 of the reset control circuit to control the first reset module 12 to be turned on. The second scan signal terminal S2 is at a high level, so the second switch transistor P2 is turned off under the control of a high-level signal of the second scan signal terminal S2. In the data write stage T2 of the pixel driving circuit 10, the first scan signal terminal S1 is at a high level, so the first switch transistor P1 is turned off under the control of a high-level signal of the first scan signal terminal S1. The second scan signal terminal S2 is at a low level, so the second switch transistor P2 is turned on under a low-level signal of the second scan signal terminal S2 and transmits a voltage of the first voltage signal terminal VGL to the output terminal S3 of the reset control circuit to control the first reset module 12 to be turned on. In other embodiments, at least one of the first switch transistor P1 or the second switch transistor P2 may further be an N-type transistor.

Figure 5:
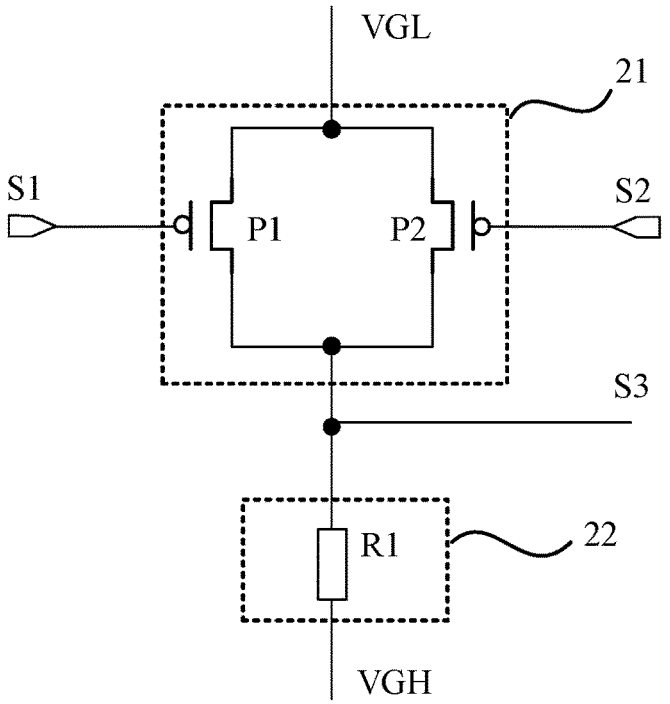
FIG. 5 is a circuit diagram of another reset control circuit according to embodiments of the present disclosure.

FIG. 5 is a circuit diagram of another reset control circuit according to embodiments of the present disclosure. Referring to FIG. 5, the second reset control module 22 includes a first resistor R1. A first terminal of the first resistor R1 is electrically connected to the second voltage signal terminal VGH, and a second terminal of the first resistor R1 is electrically connected to the output terminal S3 of the reset control circuit.

Referring to FIGS. 2 and 5, the first switch transistor P1 and the second transistor P2 are taken as P-type transistors for example. In the initial reset stage T1, the first scan signal terminal S1 is at a low level, so the first switch transistor P1 is turned on and transmits a voltage of the first voltage signal terminal VGL to the output terminal S3 of the reset control circuit to control the first reset module 12 to be turned on. The second scan signal terminal S2 is at a high level, so the second switch transistor P2 is turned off. In the data write stage T2, the first scan signal terminal S1 is at a high level, so the first switch transistor P1 is turned off. The second scan signal terminal S2 is at a low level, so the second switch transistor P2 is turned on and transmits a voltage of the first voltage signal terminal VGL to the output terminal S3 of the reset control circuit to control the first reset module 12 to be turned on. Further, in the stage T4, the first scan signal terminal S1 is at a high level, so the first switch transistor P1 is turned off under the control of a high-level signal of the first scan signal terminal S1. The second scan signal terminal S2 is at a high level, so the second switch transistor P2 is turned off under the control of a high-level signal of the second scan signal terminal S2. If the second reset control module 22 is not disposed, the output terminal S3 of the reset control circuit has no voltage input, so the voltage of the output terminal S3 of the reset control circuit is indefinite. As a result, the input voltage of the control terminal of the first reset module 12 is indefinite, and the control terminal of the first reset module 12 is vulnerable to the external electromagnetic interference and destroys the normal logical relationship, for example, destroying the normal turn-on and turn-off timing of the first reset module 12. The second reset control module 22 including the first resistor R1 is taken as an example. In the stage T4, after passing through the first resistor R1, a voltage of the second voltage signal terminal VGH is transmitted to the output terminal S3 of the reset control circuit, thereby avoiding the voltage indefiniteness of the output terminal S3 of the reset control circuit.

In an embodiment, referring to FIG. 2, the light emission stage T3 of the pixel driving circuit 10 is located after the initial reset stage T1 and the data write stage T2, and a stage between the data write stage T2 and the light emission stage T3 is denoted as stage T5. In the light emission stage T3 and the stage T5, after passing through the first resistor R1, a voltage of the second voltage signal terminal VGH is transmitted to the output terminal S3 of the reset control circuit, thereby avoiding the voltage indefiniteness of the output terminal S3 of the reset control circuit.

Figure 6:
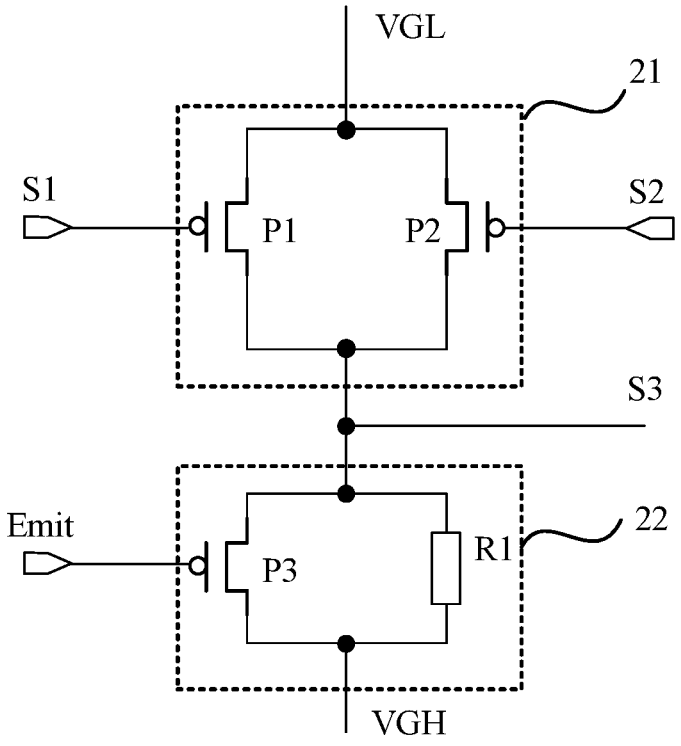
FIG. 6 is a circuit diagram of another reset control circuit according to embodiments of the present disclosure.

FIG. 6 is a circuit diagram of another reset control circuit according to embodiments of the present disclosure. Referring to FIG. 6, the second reset control module 22 includes a first resistor R1 and a third switch transistor P3. The first terminal of the first resistor R1 is electrically connected to the second voltage signal terminal VGH, and the second terminal of the first resistor R1 is electrically connected to the output terminal S3 of the reset control circuit. A gate of the third switch transistor P3 is electrically connected to the light emission signal terminal Emit, a first electrode of the third switch transistor P3 is electrically connected to the second voltage signal terminal VGH, and a second electrode of the third switch transistor P3 is electrically connected to the output terminal S3 of the reset control circuit.

Referring to FIGS. 2 and 6, the first switch transistor P1, the second transistor P2 and the third switch transistor P3 are taken as P-type transistors for example. In the initial reset stage T1, the first scan signal terminal S1 is at a low level, so the first switch transistor P1 is turned on and transmits a voltage of the first voltage signal terminal VGL to the output terminal S3 of the reset control circuit to control the first reset module 12 to be turned on. The second scan signal terminal S2 is at a high level, so the second switch transistor P2 is turned off. The light emission signal terminal Emit is at a high level, so the third switch transistor P3 is turned off. In the data write stage T2, the first scan signal terminal S1 is at a high level, so the first switch transistor P1 is turned off. The second scan signal terminal S2 is at a low level, so the second switch transistor P2 is turned on and transmits a voltage of the first voltage signal terminal VGL to the output terminal S3 of the reset control circuit to control the first reset module 12 to be turned on. The light emission signal terminal Emit is at a high level, so the third switch transistor P3 is turned off. In the light emission stage T3, the first scan signal terminal S1 is at a high level, so the first switch transistor P1 is turned off. The second scan signal terminal S2 is at a high level, so the second switch transistor P2 is turned off. The light emission signal terminal Emit is at a low level, so the third switch transistor P3 is turned on and transmits a voltage of the second voltage signal terminal VGH to the output terminal S3 of the reset control circuit to control the first reset module 12 to be turned on. Further, in the stage T4 and the stage T5, the first scan signal terminal S1 is at a high level, so the first switch transistor P1 is turned off. The second scan signal terminal S2 is at a high level, so the second switch transistor P2 is turned off. The light emission signal terminal Emit is at a high level, so the third switch transistor P3 is turned off. After passing through the first resistor R1, a voltage of the second voltage signal terminal VGH is transmitted to the output terminal S3 of the reset control circuit, thereby avoiding the voltage indefiniteness of the output terminal S3 of the reset control circuit.

Figure 7:
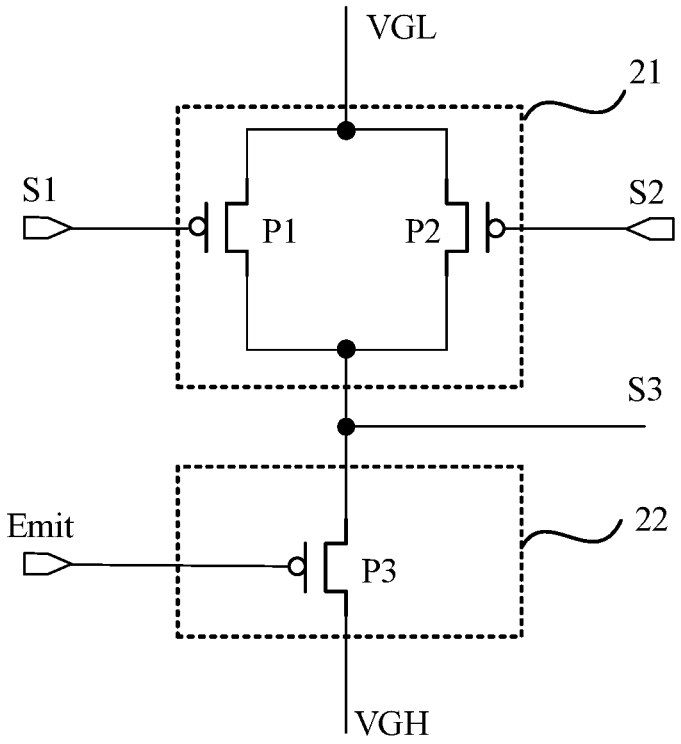
FIG. 7 is a circuit diagram of another reset control circuit according to embodiments of the present disclosure.

FIG. 7 is a circuit diagram of another reset control circuit according to embodiments of the present disclosure. Referring to FIG. 7, the second reset control module 22 includes a third switch transistor P3. The gate of the third switch transistor P3 is electrically connected to the light emission signal terminal Emit, the first electrode of the third switch transistor P3 is electrically connected to the second voltage signal terminal VGH, and the second electrode of the third switch transistor P3 is electrically connected to the output terminal S3 of the reset control circuit. For turn-on and turn-off situations of the third transistor P3 according to timing, see description in the preceding embodiments. The situations are not repeated here.

Figure 8:
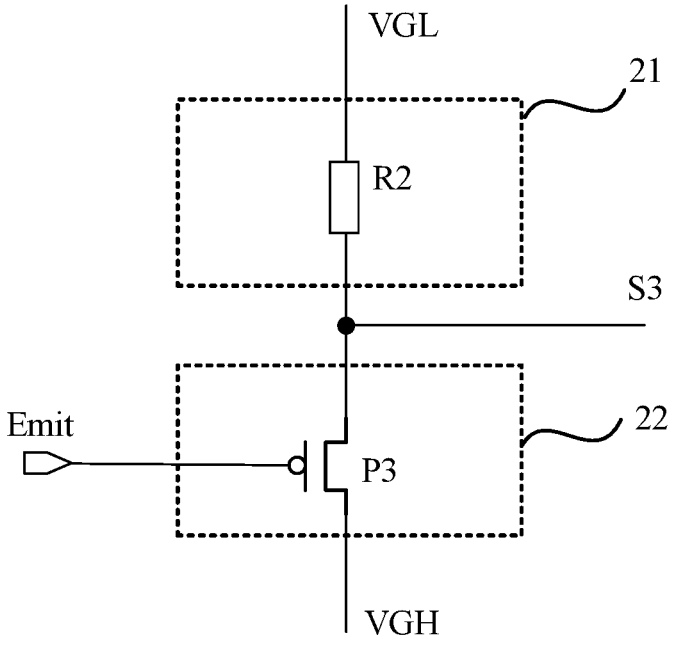
FIG. 8 is a circuit diagram of another reset control circuit according to embodiments of the present disclosure.
Figure 9:
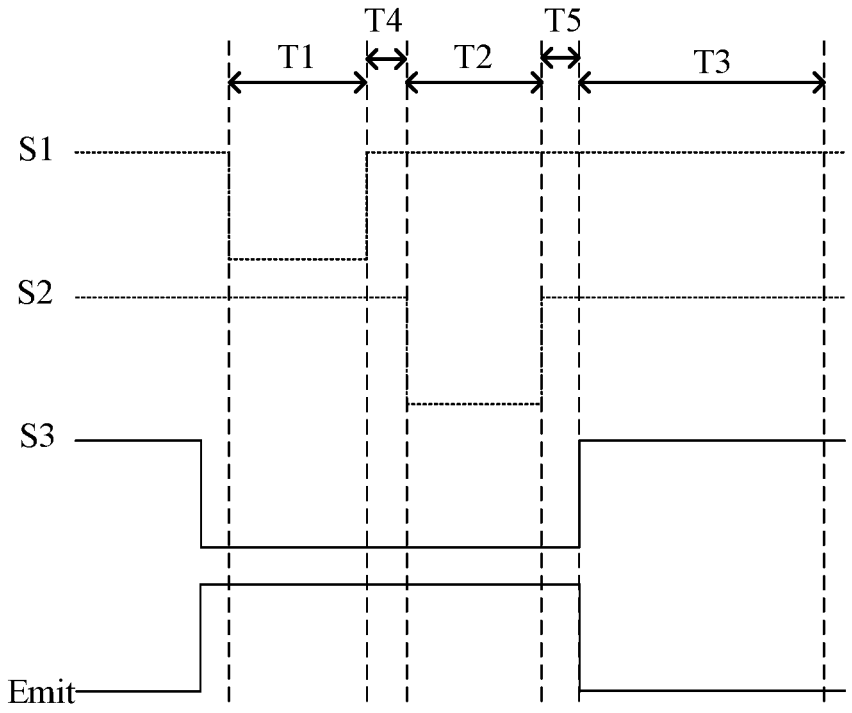
FIG. 9 is a timing diagram of another pixel driving circuit according to embodiments of the present disclosure.

FIG. 8 is a circuit diagram of another reset control circuit according to embodiments of the present disclosure, and FIG. 9 is a timing diagram of another pixel driving circuit according to embodiments of the present disclosure. Referring to FIGS. 8 and 9, the second reset control module 22 is configured to control the output terminal S3 of the reset control circuit to be at a low level and the first reset module 12 to be turned on in the stage (denoted as stage T4) between the initial reset stage T1 and the data write stage T2. It is to be noted that in the stage T4, the second reset control module 22 is configured to control the first reset module 12 to be turned on, thereby avoiding the voltage indefiniteness of the output terminal S3 of the reset control circuit. Besides, after the first reset module 12 is turned on, a reset voltage of the reset voltage terminal Vref may be applied to the first electrode of the light-emitting element 11, thereby avoiding no voltage input of the first electrode of the light-emitting element 11 and the voltage indefiniteness of the first electrode of the light-emitting element 11, enhancing the anti-electromagnetic interference ability of the first electrode of the light-emitting element 11, and avoiding undesired light emission of the light-emitting element 11. Further, since a reset voltage of the reset voltage terminal Vref may be applied to the first electrode of the light-emitting element 11 to reset the first electrode of the light-emitting element 11 in the stage 4, the first electrode of the light-emitting element 11 can be reset in the initial reset stage T1, the data write stage T2 and the stage 4. In this manner, the reset time is increased, the reset is relatively sufficient, and the problem of undesired light emission in the case of a low grayscale and a high frequency is alleviated.

In an embodiment, referring to FIGS. 8 and 9, in the stage T5, the second reset control module 22 is configured to control the output terminal S3 of the reset control circuit to be at a low level and the first reset module 12 to be turned on so as to apply a reset voltage of the reset voltage terminal Vref to the first electrode of the light-emitting element 11. In the light emission stage T3, the second reset control module 22 is configured to control the output terminal S3 of the reset control circuit to be at a high level and the first reset module 12 to be turned off.

In an embodiment, referring to FIG. 8, the first reset control module 21 includes a second resistor R2. A first terminal of the second resistor R2 is electrically connected to the first voltage signal terminal VGL, and a second terminal of the second resistor R2 is electrically connected to the output terminal S3 of the reset control circuit.

Referring to FIGS. 8 and 9, the third switch transistor P3 is taken as a P-type transistor for example. In the initial reset stage T1 and the data write stage T2, the light emission signal terminal Emit is at a high level, so the third switch transistor P3 is turned off, and a voltage of the first voltage signal terminal VGL is transmitted to the output terminal S3 of the reset control circuit through the second resistor R2 to control the first reset module 12 to be turned on. In the light emission stage T3, the light emission signal terminal Emit is at a low level, so the third switch transistor P3 is turned on and transmits a voltage of the second voltage signal terminal VGH to the output terminal S3 of the reset control circuit to control the first reset module 12 to be turned off. Further, in the stage T4 and the stage T5, the light emission signal terminal Emit is at a high level, so the third switch transistor P3 is turned off, and a voltage of the first voltage signal terminal VGL is transmitted to the output terminal S3 of the reset control circuit through the second resistor R2 to control the first module 12 to be turned on, which avoids not only the voltage indefiniteness of the output terminal S3 of the reset control circuit, but also the voltage indefiniteness of the first electrode of the light-emitting element 11, enhances the anti-electromagnetic interference ability of the first electrode of the light-emitting element 11, and avoids undesired light emission of the light-emitting element 11. Further, since in the stage T4 and the stage T5, a reset voltage of the reset voltage terminal Vref may be applied to the first electrode of the light-emitting element 11 to reset the first electrode of the light-emitting element 11, the first electrode of the light-emitting element 11 can be reset in the initial reset stage T1, the data write stage T2, the stage 4, and the stage T5. In this manner, the reset time is increased, the reset is relatively sufficient, and the problem of undesired light emission in the case of a low grayscale and a high frequency is alleviated.

Figure 10:
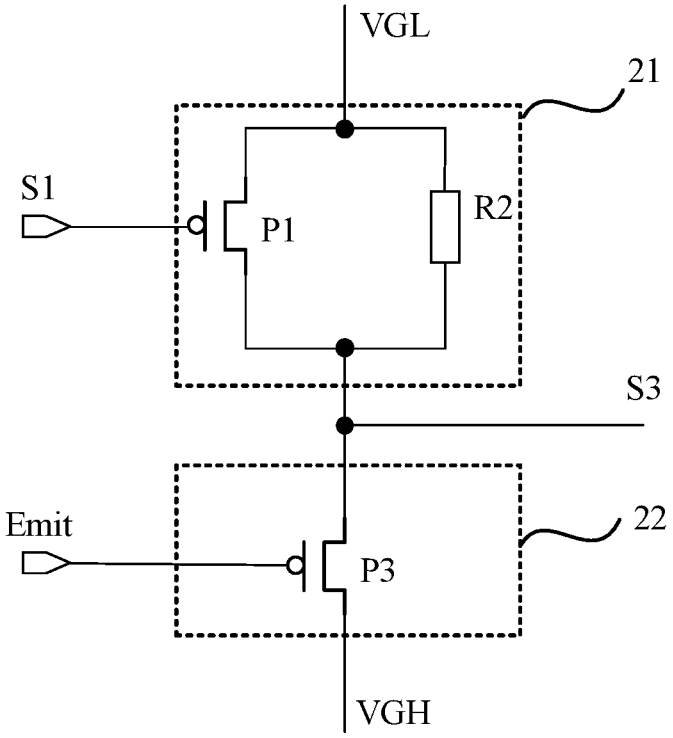
FIG. 10 is a circuit diagram of another reset control circuit according to embodiments of the present disclosure.
Figure 11:
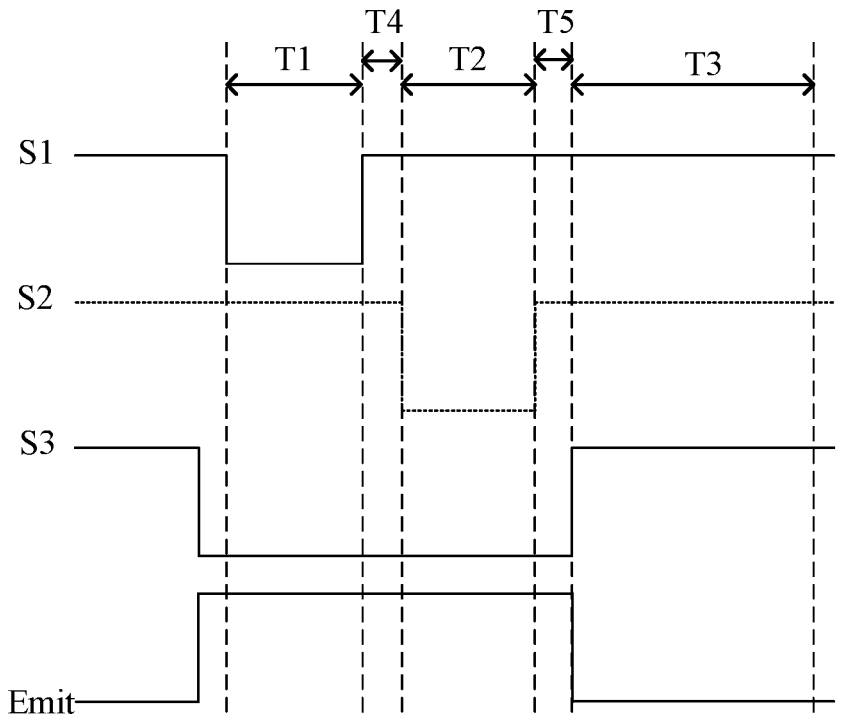
FIG. 11 is a timing diagram of another pixel driving circuit according to embodiments of the present disclosure.

FIG. 10 is a circuit diagram of another reset control circuit according to embodiments of the present disclosure, and FIG. 11 is a timing diagram of another pixel driving circuit according to embodiments of the present disclosure. Referring to FIGS. 10 and 11, the first reset control module 21 includes a first switch transistor P1 and a second resistor R2. A first terminal of the second resistor R2 is electrically connected to the first voltage signal terminal VGL, and a second terminal of the second resistor R2 is electrically connected to the output terminal S3 of the reset control circuit. A gate of the first switch transistor P1 is electrically connected to the first scan signal terminal S1, a first electrode of the first switch transistor P1 is electrically connected to the first voltage signal terminal VGL, and a second electrode of the first switch transistor P1 is electrically connected to the output terminal S3 of the reset control circuit.

Referring to FIGS. 10 and 11, the first switch transistor P1 and the third transistor P3 are taken as P-type transistors for example. In the initial reset stage T1, the first scan signal terminal S1 is at a low level, so the first switch transistor P1 is turned on and transmits a voltage of the first voltage signal terminal VGL to the output terminal S3 of the reset control circuit to control the first reset module 12 to be turned on. The light emission signal terminal Emit is at a high level, so the third switch transistor P3 is turned off. In the data write stage T2, the first scan signal terminal S1 is at a high level, so the first switch transistor P1 is turned off. The light emission signal terminal Emit is at a high level, so the third switch transistor P3 is turned off. A voltage of the first voltage signal terminal VGL is transmitted to the output terminal S3 of the reset control circuit through the second resistor R2 to control the first reset module 12 to be turned on. In the light emission stage T3, the first scan signal terminal S1 is at a high level, so the first switch transistor P1 is turned off. The light emission signal terminal Emit is at a low level, so the third switch transistor P3 is turned on and transmits a voltage of the second voltage signal terminal VGH to the output terminal S3 of the reset control circuit to control the first reset module 12 to be turned on. Further, in the stage T4 and the stage T5, the first scan signal terminal S1 is at a high level, so the first switch transistor P1 is turned off. The light emission signal terminal Emit is at a high level, so the third switch transistor P3 is turned off. A voltage of the first voltage signal terminal VGL is transmitted to the output terminal S3 of the reset control circuit through the second resistor R2 to control the first module 12 to turn on, which avoids not only the voltage indefiniteness of the output terminal S3 of the reset control circuit, but also the voltage indefiniteness of the first electrode of the light-emitting element 11, enhances the anti-electromagnetic interference ability of the first electrode of the light-emitting element 11, and avoids undesired light emission of the light-emitting element 11. Further, the first electrode of the light-emitting element 11 can be reset in the initial reset stage T1, the data write stage T2, the stage 4, and the stage T5. In this manner, the reset time is increased, the reset is relatively sufficient, and the problem of undesired light emission in the case of a low grayscale and a high frequency is alleviated.

Figure 12:
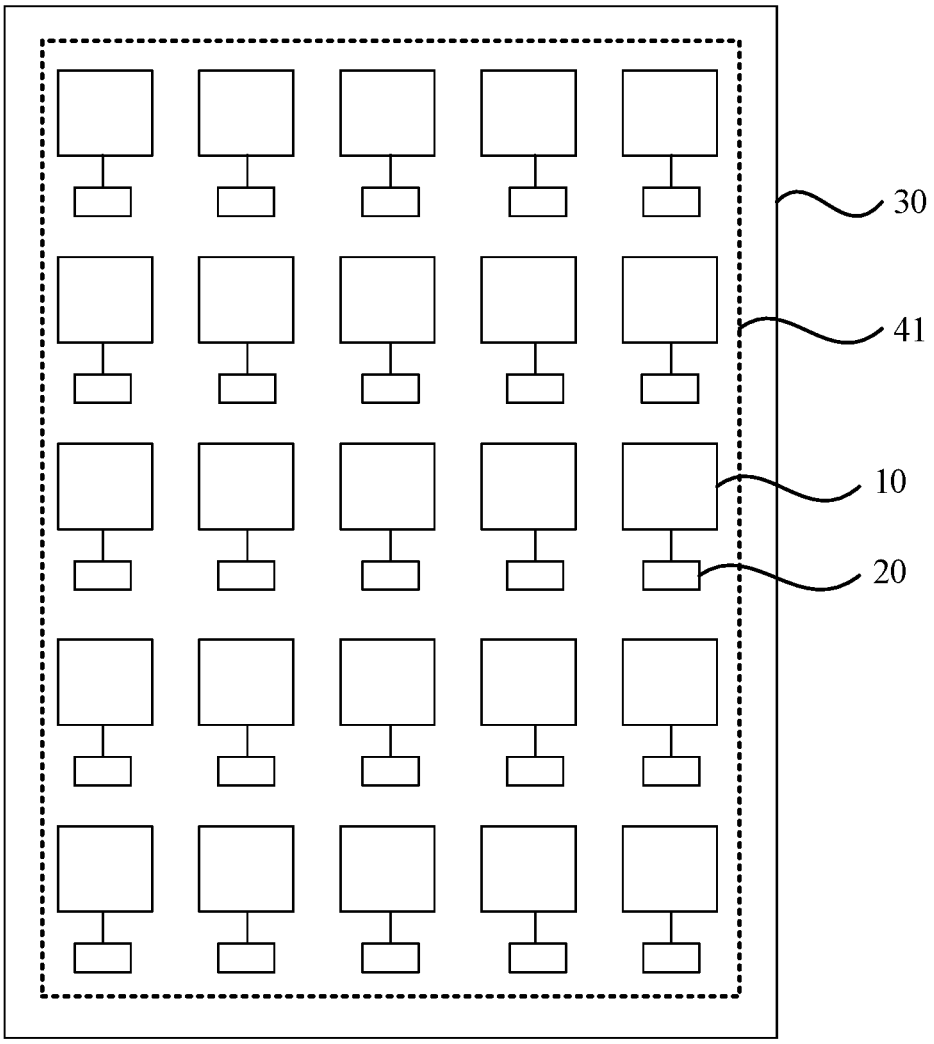
FIG. 12 is a top view illustrating the structure of a display panel according to embodiments of the present disclosure.

In other embodiments, the first reset control module 21 includes a second switch transistor P2 and a second resistor R2.A first terminal of the second resistor R2 is electrically connected to the first voltage signal terminal VGL, and a second terminal of the second resistor R2 is electrically connected to the output terminal S3 of the reset control circuit. A gate of the second switch transistor P2 is electrically connected to the second scan signal terminal S2, a first electrode of the second switch transistor P2 is electrically connected to the first voltage signal terminal VGL, and a second electrode of the second switch transistor P2 is electrically connected to the output terminal S3 of the reset control circuit. FIG. 12 is a top view illustrating the structure of a display panel according to embodiments of the present disclosure. Referring to FIG. 12, the display panel includes a display region 41. The pixel driving circuit 10 and the reset control circuit 20 are both located in the display region 41. The number of pixel driving circuits 10 is equal to the number of reset control circuits 20. The pixel driving circuits 10 are electrically connected to the reset control circuits 20 in a one-to-one manner. The reset control circuits 20 are configured to control the first reset modules 12 in the pixel driving circuits 10 corresponding to the reset control circuits one to one to be turned on or turn off.

Figure 13:
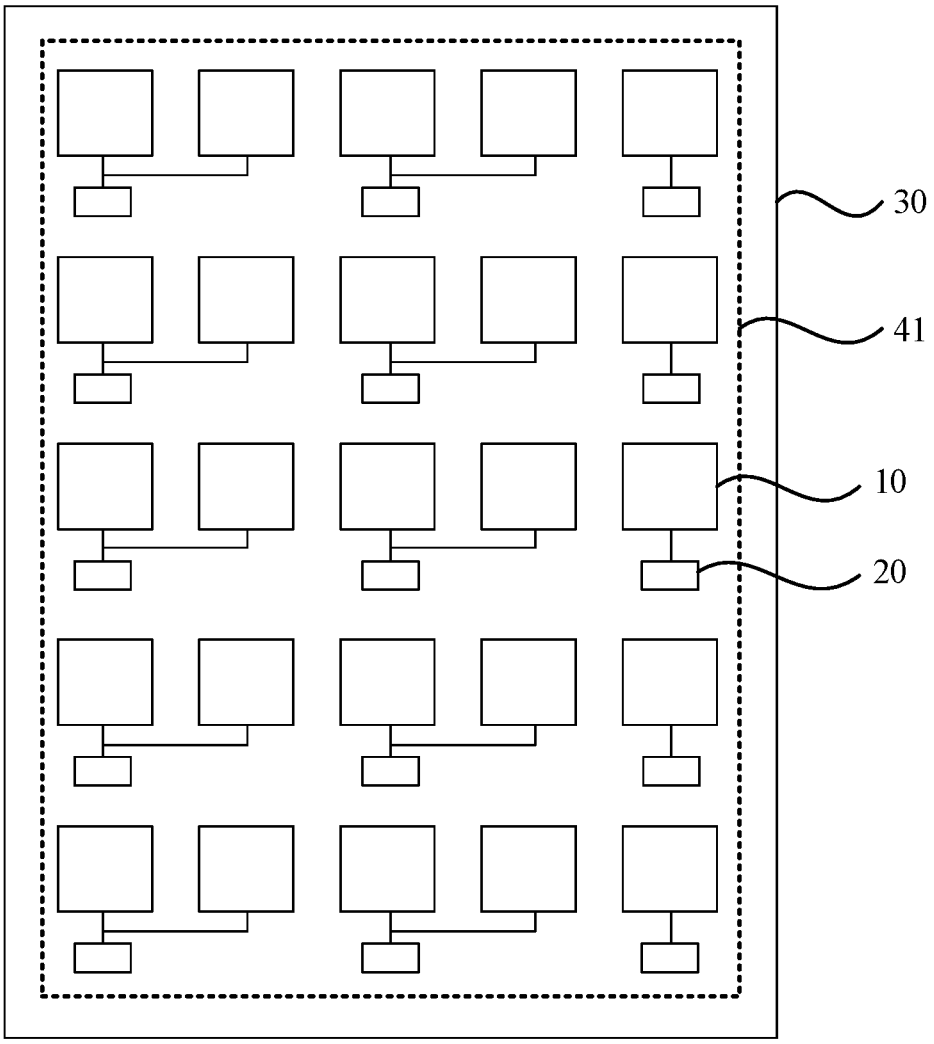
FIG. 13 is a top view illustrating the structure of another display panel according to embodiments of the present disclosure.

FIG. 13 is a top view illustrating the structure of another display panel according to embodiments of the present disclosure. Referring to FIG. 13, the number of pixel driving circuits 10 is greater than the number of reset control circuits 20. At least one reset control circuit 20 exists. The at least one reset control circuit 20 is electrically connected to at least two pixel driving circuits 10 and configured to control the first reset modules 12 in the at least two pixel driving circuits 10 electrically connected to the at least one reset control circuit 20 to be turned on or turn off. In the embodiments of the present disclosure, since the number of pixel driving circuits 10 is greater than the number of reset control circuits 20, a small number of reset control circuits 20 can be used for controlling all the pixel driving circuits 10 on the premise that the number of pixel driving circuits is fixed, thereby reducing the number of reset control circuits 20, lowering the cost of the display panel, and reducing the space occupied by the reset control circuits 20 in the display region 41.

Figure 14:
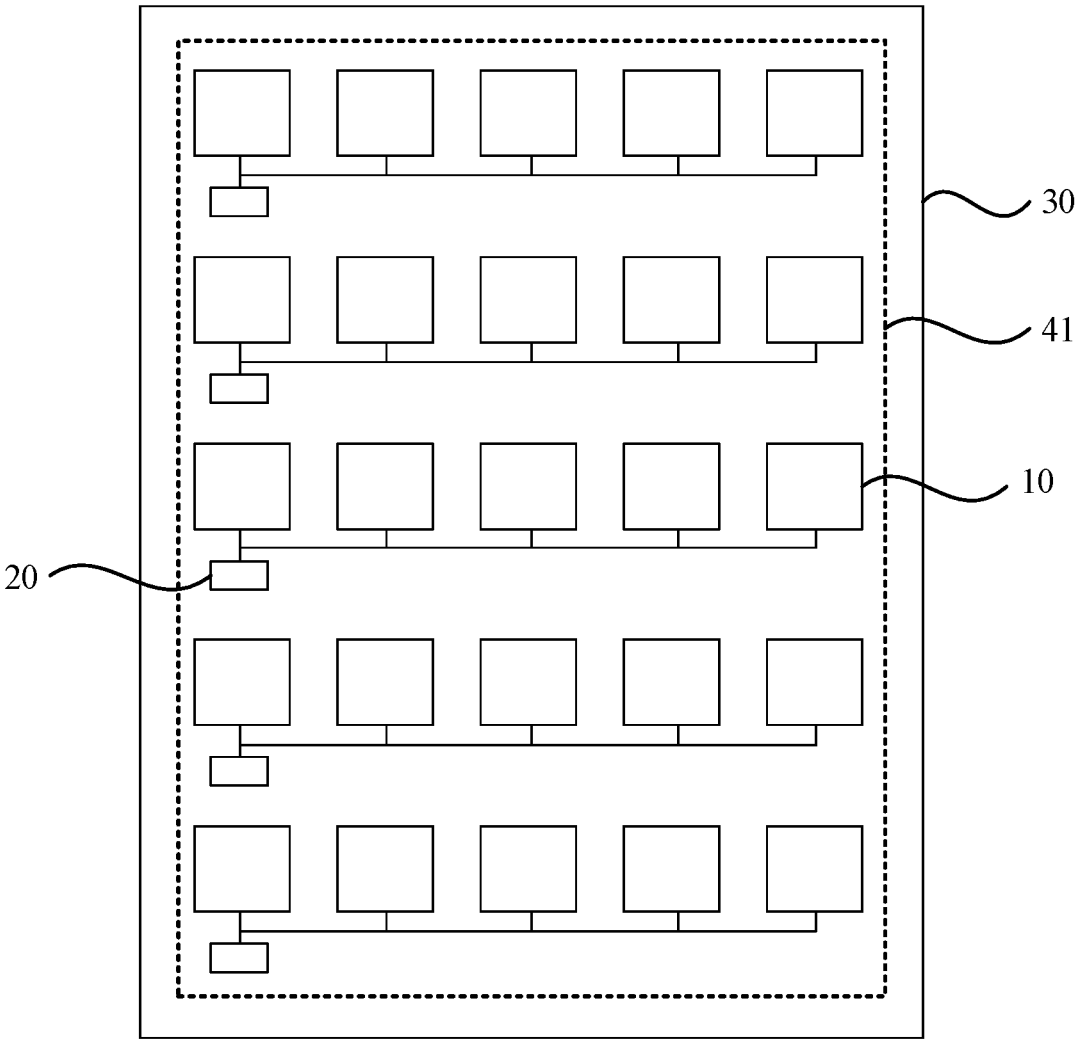
FIG. 14 is a top view illustrating the structure of another display panel according to embodiments of the present disclosure.

FIG. 14 is a top view illustrating the structure of another display panel according to embodiments of the present disclosure. Referring to FIG. 14, a same row of pixel driving circuits 10 share the same reset control circuit 20. In the embodiments of the present disclosure, the same row of pixel driving circuits 10 share the same reset control circuit 20 so that each row of pixel driving circuits 10 is correspondingly provided with a reset control circuit 20, further reducing the number of reset control circuits 20.

Figure 15:
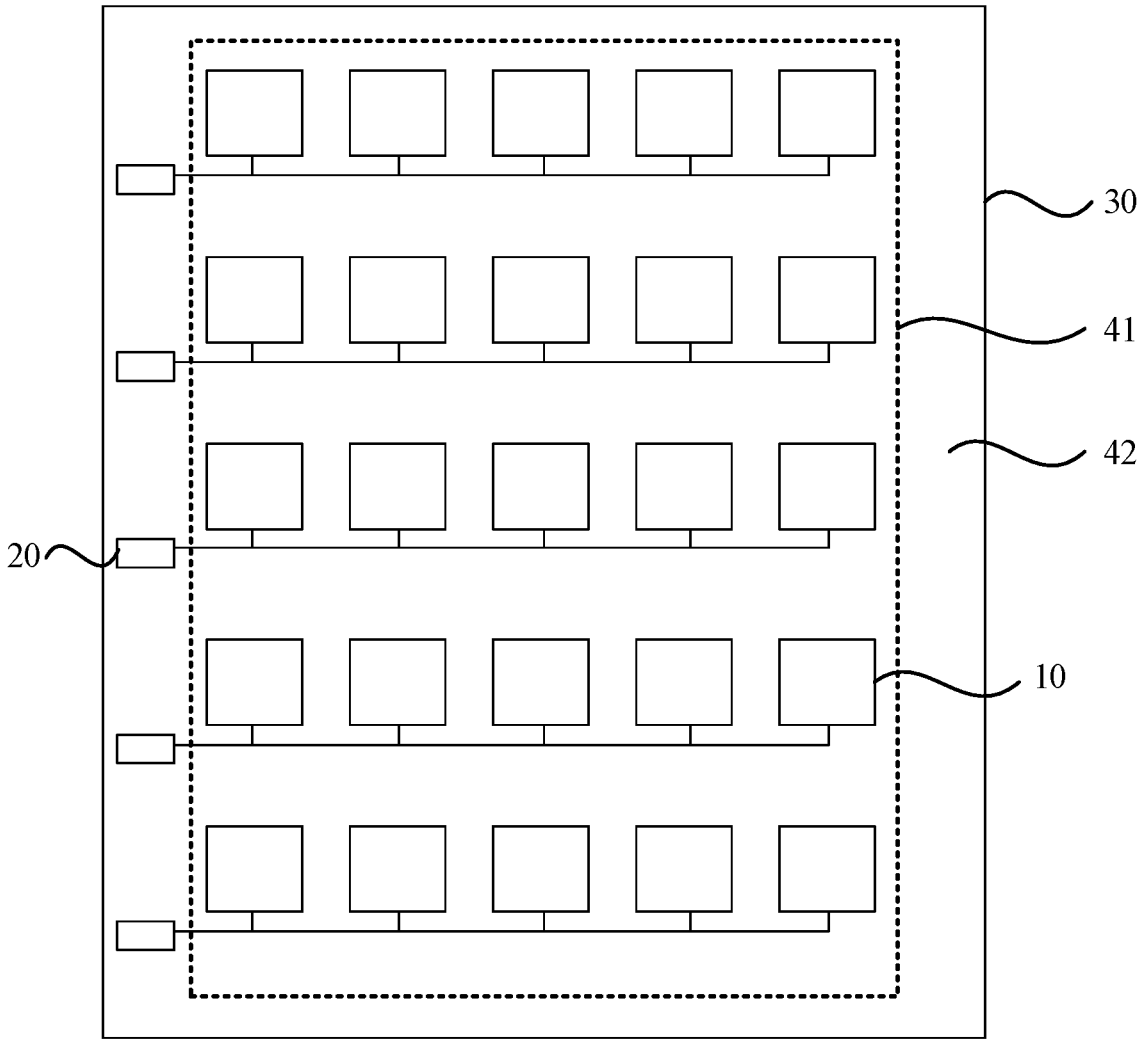
FIG. 15 is a top view illustrating the structure of another display panel according to embodiments of the present disclosure.

FIG. 15 is a top view illustrating the structure of another display panel according to embodiments of the present disclosure. Referring to FIG. 15, the display panel includes a display region 41 and a bezel region 42 around the display region 41. The pixel driving circuit 10 is located in the display region 41, and the reset control circuit 20 is located in the bezel region 42. The same row of pixel driving circuits 10 share the same reset control circuit 20. In the embodiments of the present disclosure, the reset control circuit 20 is located in the bezel region 42. The reset control circuit 20 is not located in the display region 42 and thereby does not occupy the space of the display region 41. Each row of pixel driving circuits 10 is provided with a reset control circuit 20, thereby reducing the number of reset control circuits 10.

In an embodiment, referring to FIGS. 12 to 15, the display panel further includes a substrate 30. The pixel driving circuit 10 and the reset control circuit 20 are located on the substrate 30 and on the same side of the substrate 30.

In an embodiment, referring to FIG. 1, the first reset module 12 includes a first transistor M1. A gate of the first transistor M1 is electrically connected to the output terminal S3 of the reset control circuit, a first electrode of the first transistor M1 is electrically connected to the reset voltage terminal Vref, and a second electrode of the first transistor M1 is electrically connected to the first electrode of the light-emitting element 11.

In an embodiment, referring to FIGS. 1 and 2, the first transistor M1 is taken as a P-type transistor for example. In the initial reset stage T1, the output terminal S3 of the reset control circuit is at a low level and configured to control the first transistor M1 to be turned on, so a reset voltage of the reset voltage terminal Vref is applied to the first electrode of the light-emitting element 11 so as to reset the first electrode of the light-emitting element 11 for the first time. In the data write stage T2, the output terminal S3 of the reset control circuit is at a low level and configured to control the first transistor M1 to be turned on, a reset voltage of the reset voltage terminal Vref is applied to the first electrode of the light-emitting element 11 so as to reset the first electrode of the light-emitting element 11 for the second time. In other embodiments, the first transistor M1 may further be an N-type transistor.

In an embodiment, in some embodiments, the first transistor M1 may be a double-gate transistor, that is, the first transistor M1 is a double-gate metal-oxide-semiconductor (MOS) field-effect transistor. The double-gate MOS field-effect transistor is a new high-frequency low noise amplifier. The outstanding advantage is that the feedback capacitor is two orders lower than the feedback capacitor of the single-gate MOS field-effect transistor, so the double-gate MOS field-effect transistor can stably work within the range of very high frequency and ultrahigh frequency.

In an embodiment, referring to FIG. 1, the pixel driving circuit 10 further includes a threshold compensation module 18 and a retention module 19. A control terminal of the threshold compensation module 18 is electrically connected to the second scan signal terminal S2, a first terminal of the threshold compensation module 18 is electrically connected to the gate of the driving transistor 15, and a second terminal of the threshold compensation module 18 is electrically connected to the second electrode of the driving transistor 15. The threshold compensation module 18 is configured to control the turn-on states of the gate of the driving transistor 15 and the first electrode of the driving transistor 15 based on the second scan signal terminal S2. A first terminal of the retention module 19 is electrically connected to the second constant voltage terminal PVDD, and a second terminal of the retention module 19 is electrically connected to the gate of the driving transistor 15.

Figure 16:
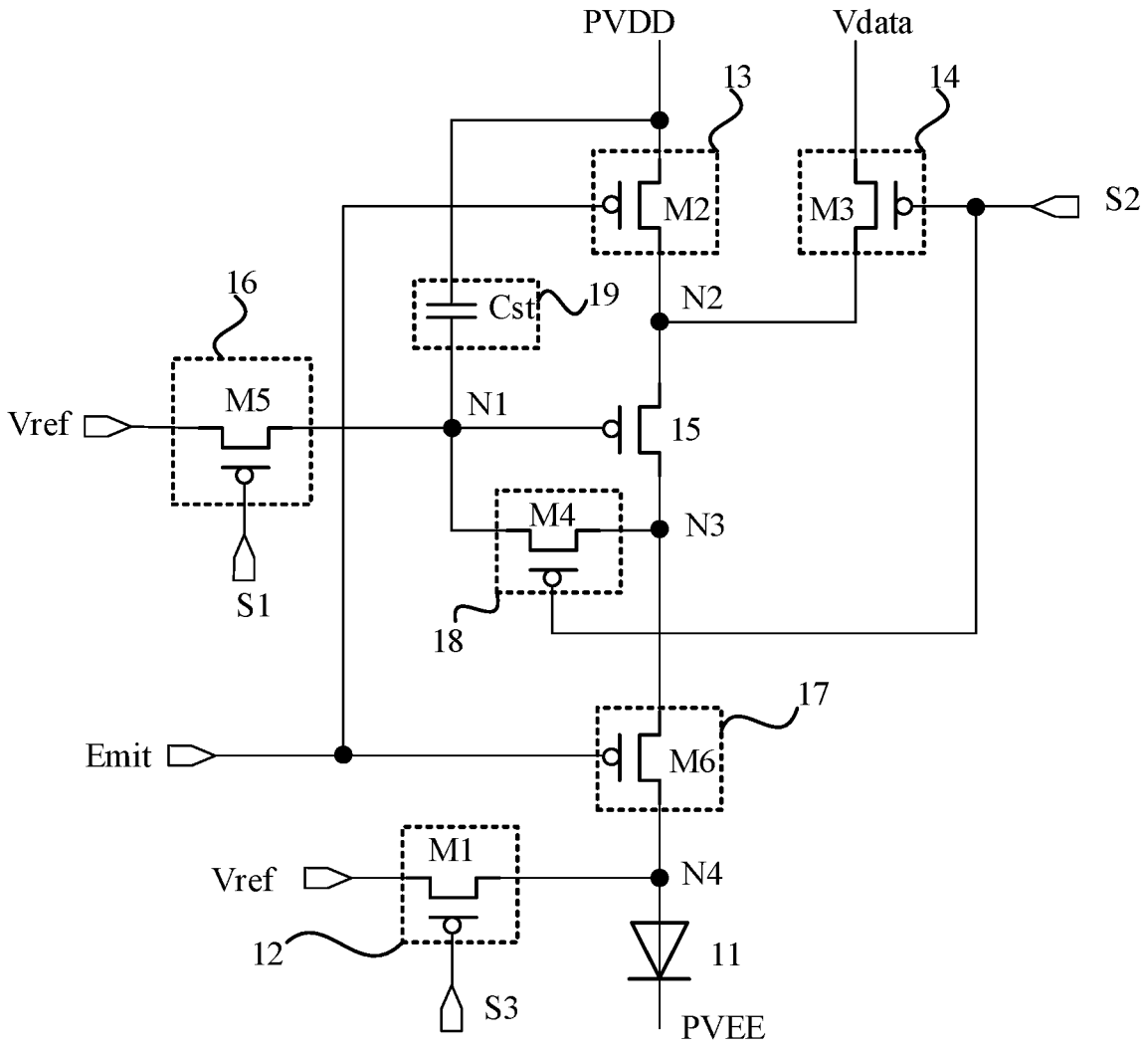
FIG. 16 is a circuit diagram of a pixel driving circuit according to embodiments of the present disclosure.

FIG. 16 is a circuit diagram of a pixel driving circuit according to embodiments of the present disclosure. Referring to FIG. 16, the first control module 13 includes a second transistor M2, the data write module 14 includes a third transistor M3, the threshold compensation module 18 includes a fourth transistor M4, the second reset module 16 includes a fifth transistor M5, the second control module 17 includes a sixth transistor M6, and the retention module includes a storage capacitor Cst. A gate of the second transistor M2 is electrically connected to the light emission signal terminal Emit, a first electrode of the second transistor M2 is electrically connected to the second constant voltage terminal PVDD, and a second electrode of the second transistor M2 is electrically connected to the first electrode of the driving transistor 15. A gate of the third transistor M3 is electrically connected to the second scan signal terminal S2, a first electrode of the third transistor M3 is electrically connected to the data signal terminal Vdata, and a second electrode of the third transistor M3 is electrically connected to the first electrode of the driving transistor 15. A gate of the fourth transistor M4 is electrically connected to the second scan signal terminal S2, a first electrode of the fourth transistor M4 is electrically connected to the gate of the driving transistor 15, and a second electrode of the fourth transistor M4 is electrically connected to the second electrode of the driving transistor 15. A gate of the fifth transistor M5 is electrically connected to the first scan signal terminal S1, a first electrode of the fifth transistor M5 is electrically connected to the reset voltage terminal Vref, and a second electrode of the fifth transistor M5 is electrically connected to the gate of the driving transistor 15. A gate of the sixth transistor M6 is electrically connected to the light emission signal terminal Emit, a first electrode of the sixth transistor M6 is electrically connected to the second electrode of the driving transistor 15, and a second electrode of the sixth transistor M6 is electrically connected to the first electrode of the light-emitting element 11. A first plate of the storage capacitor Cst is electrically connected to the second constant voltage terminal PVDD, and a second plate of the storage capacitor Cst is electrically connected to the gate of the driving transistor 15.

In an embodiment, referring to FIGS. 1 and 2 and 16, in the initial reset stage T1, a first scan turn-on signal is input to the first scan signal terminal S1 of the pixel driving circuit 10, and the second reset module 16 is turned on under the control of the first scan turn-on signal and applies a reset voltage of the reset voltage terminal Vref to the first electrode of the light-emitting element 11 so as to reset the first electrode of the light-emitting element 11. The first scan turn-on signal is an enable level signal that turns on the second reset module 16. For example, when the second reset module 16 includes a fifth transistor M5 that is a P-type transistor, the first scan turn-on signal is a low-level signal. In the data write stage T2, a second scan turn-on signal is input to the second scan signal terminal S2 of the pixel driving circuit 10, and the data write module 14 is turned on under the control of the second scan turn-on signal and writes a data signal of the data signal terminal Vdata to the gate of the driving transistor 15. The second scan turn-on signal is an enable level signal that turns on the data write module 14. For example, when the data write module 14 includes a third transistor M3 that is a P-type transistor, the second scan turn-on signal is a low-level signal.

In an embodiment, referring to FIG. 16, the second transistor M2, the third transistor M3, the fourth transistor M4, the fifth transistor M5 and the sixth transistor M6 each are P-type transistors. In other embodiments, at least one of the second transistor M2, the third transistor M3, the fourth transistor M4, the fifth transistor M5 or the sixth transistor M6 may be further an N-type transistor.

Referring to FIGS. 2 and 16, the second electrode of the fifth transistor M5, the second plate of the storage capacitor Cst, the gate of the driving transistor 15 and the first electrode of the fourth transistor M4 are electrically connected to the first node N1. The second electrode of the second transistor M2, the second electrode of the third transistor M3 and the first electrode of the driving transistor 15 are connected to the second node N2. The second electrode of the driving transistor 15, the second electrode of the fourth transistor M4 and the first electrode of the sixth transistor M6 are connected to the third node N3. The second electrode of the first transistor M1, the second electrode of the sixth transistor M6 and the first electrode of the light-emitting element 11 are connected to the fourth node N4. The second transistor M2, the third transistor M3, the fourth transistor M4, the fifth transistor M5 and the sixth transistor M6 are taken as P-type transistors for example. The working process of the pixel driving circuit 10 includes as follows. In the initial reset stage T1, the first scan signal terminal S1 is at a low level, so the fifth transistor M5 is turned on and applies a reset voltage of the reset voltage terminal Vref to the first node N1 to reset the gate of the driving transistor 15. The second scan signal terminal S2 is at a high level, so the third transistor M3 and the fourth transistor M4 are turned off. The output terminal S3 of the reset control circuit is at a low level, so the first transistor M1 is turned on and applies a reset voltage of the reset voltage terminal Vref to the fourth node N4 to reset the light-emitting element 11. The light emission terminal Emit is at a high level, so the second transistor M2 and the sixth transistor M6 are turned off. In the data write stage T2, the first scan signal terminal S1 is at a high level, so the fifth transistor M5 is turned off. The second scan signal terminal S2 is at a low level, so the third transistor M3 and the fourth transistor M4 are turned on. Since a reset voltage of the reset voltage terminal Vref is applied to the gate of the driving transistor 15, the reset voltage of the reset voltage terminal Vref is negative. The third transistor M3 is turned on, and a data signal of the data signal terminal Vdata is written to the second node N2, so the voltage value of the data signal of the data signal terminal Vdata is positive. When the voltage difference between the second node N2 and the first node N1 is greater than the threshold voltage |Vth| of the driving transistor 15, the driving transistor 15 is turned on. When the fourth transistor M4 is turned on, the voltage of the first node N1 is equal to the voltage of the third node N3, and the voltage of the first node N1 is VDATA−|Vth|. The voltage of the second node N2 is VDATA that is the data voltage written to the second node N2 (that is the voltage of the data signal). In the embodiments of the present disclosure, the threshold compensation of the driving transistor 15 is performed while the data write is performed at the same time. The output terminal S3 of the reset control circuit is at a low level, so the first transistor M1 is turned on and applies a reset voltage of the reset voltage terminal Vref to the fourth node N4 to reset the light-emitting element 11. The light emission terminal Emit is at a high level, so the second transistor M2 and the sixth transistor M6 are turned off. In the light emission stage T3, the first scan signal terminal S1 is at a high level, so the fifth transistor M5 is turned off. The second scan signal terminal S2 is at a high level, so the third transistor M3 and the fourth transistor M4 are turned off. The output terminal S3 of the reset control circuit is at a high level, so the first transistor M1 is turned off. The light emission terminal Emit is at a low level, so the second transistor M2 and the sixth transistor M6 are turned on. The second transistor M2 is turned on, so a voltage Pvdd of the second constant voltage terminal PVDD is transmitted to the second node N2. The voltage of the second node N2 is the voltage of the second constant voltage terminal PVDD, that is, Pvdd. The voltage of the first node N1 is VDATA−|Vth|. When the voltage difference between the second node N2 and the first node N1 is greater than the threshold voltage |Vth| of the driving transistor 15, the driving transistor 15 is turned on and generates a driving current to drive the light-emitting element 11 to emit light. The voltage of the third node N3 is Pvee+Voled. Pvee is the voltage of the first constant voltage terminal PVEE and negative. Voled is the voltage corresponding to the light-emitting element 11.

Figure 17:
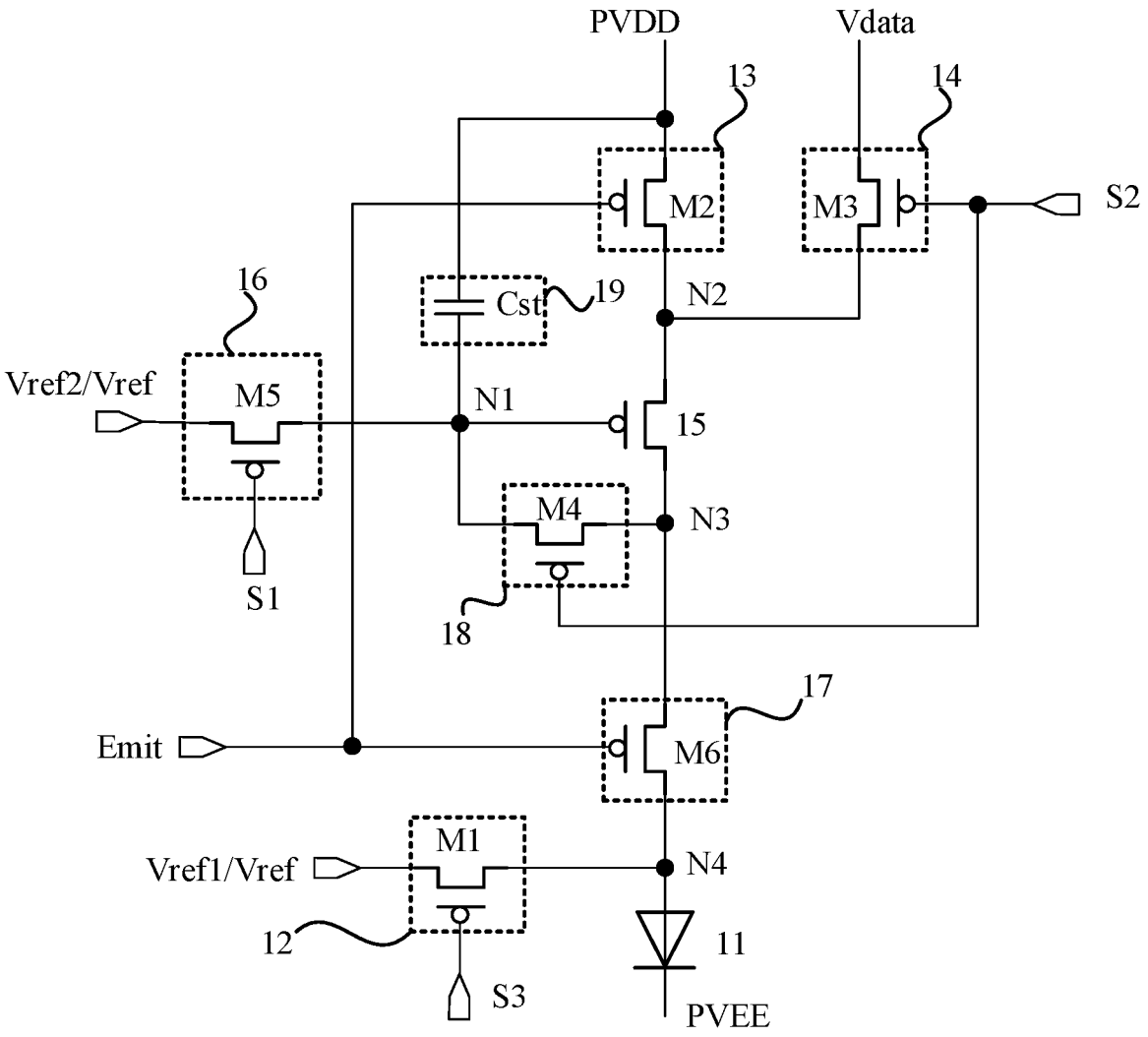
FIG. 17 is a circuit diagram of another pixel driving circuit according to embodiments of the present disclosure.

FIG. 17 is a circuit diagram of another pixel driving circuit according to embodiments of the present disclosure. Referring to FIG. 17, the reset voltage terminal Vref electrically connected to the first terminal of the first reset module 12 is the first reset voltage terminal Vref1. The reset voltage terminal Vref electrically connected to the first terminal of the second reset module 16 is the second reset voltage terminal Vref2. The closer the voltage of the control terminal of driving transistor 15 is to VDATA−|Vth| after the data write stage by supplying a higher reset voltage signal to the control terminal of the driving transistor 15, the faster the threshold of the control terminal of the driving transistor 15 is captured. When applied in the high-frequency display or low-brightness (or low-grayscale) display, the shorter the threshold capture time of the control terminal of the driving transistor 15 is, the faster the threshold of the control terminal of the driving transistor 15 is captured. Thus, the threshold can be captured more accurately so as to reduce the display non-uniformity. In the meanwhile, when the first electrode of the light-emitting element 11 is reset, with a lower reset voltage signal supplied to the first electrode of the light-emitting element 11, undesired light emission of the light-emitting element 11 can be alleviated, and the display effect in the case of a low grayscale can be improved.

Figure 18:
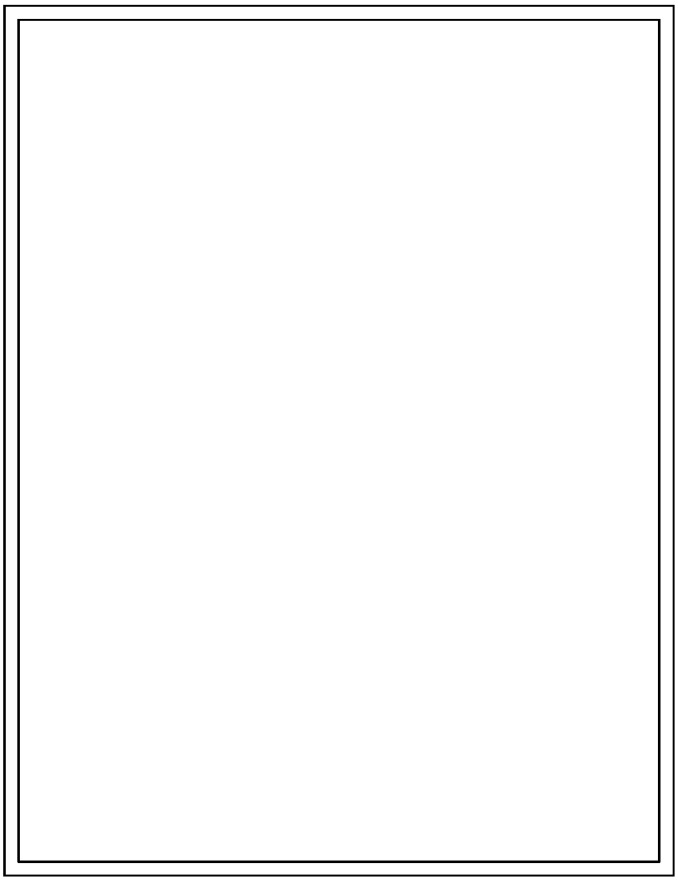
FIG. 18 is a diagram of a display device according to embodiments of the present disclosure.

Embodiments of the present disclosure further provide a display device. FIG. 18 is a diagram illustrating the structure of a display device according to embodiments of the present disclosure. Referring to FIG. 18, the display device includes any one of the display panels provided by embodiments of the present disclosure. The display device may be, for example, a mobile phone, a tablet computer, a vehicle-mounted display device, and a smart wearable device.

It is to be noted that the above are only preferred embodiments of the present disclosure and technical principles used therein. It is to be understood by those skilled in the art that the present disclosure is not limited to the embodiments described herein. Those skilled in the art can make various apparent modifications, adaptations, combinations and substitutions without departing from the scope of the present disclosure. Therefore, while the present disclosure has been described in detail through the preceding embodiments, the present disclosure is not limited to the preceding embodiments and may include more other equivalent embodiments without departing from the concept of the present disclosure. The scope of the present disclosure is determined by the scope of the appended claims.

What is claimed is:

1. A display panel, comprising a pixel driving circuit and a reset control circuit, wherein the pixel driving circuit comprises a light-emitting element, a first reset module, a first control module, a data write module, a driving transistor, a second reset module, and a second control module, wherein the first reset module comprises a first transistor, the first control module comprises a second transistor, the data write module comprises a third transistor, the second reset module comprises a fifth transistor, and the second control module comprises a sixth transistor, and wherein a control terminal of the first reset module is electrically connected to an output terminal of the reset control circuit, a first terminal of the first reset module is electrically connected to a reset voltage terminal, a second terminal of the first reset module is electrically connected to a first electrode of the light-emitting element, a second electrode of the light-emitting element is electrically connected to a first constant voltage terminal, a control terminal of the second reset module is electrically connected to a first scan signal terminal, a first terminal of the second reset module is electrically connected to the reset voltage terminal, a second terminal of the second reset module is electrically connected to a gate of the driving transistor, a control terminal of the data write module is electrically connected to a second scan signal terminal, a first terminal of the data write module is electrically connected to a data signal terminal, a second terminal of the data write module is electrically connected to a first electrode of the driving transistor, a control terminal of the first control module is electrically connected to a light emission signal terminal, a first terminal of the first control module is electrically connected to a second constant voltage terminal, a second terminal of the first control module is electrically connected to the first electrode of the driving transistor, a control terminal of the second control module is electrically connected to the light emission signal terminal, a first terminal of the second control module is electrically connected to a second electrode of the driving transistor, and a second terminal of the second control module is electrically connected to the first electrode of the light-emitting element;

wherein in an initial reset stage of the pixel driving circuit, the reset control circuit is configured to control the first reset module to be turned on and apply a reset voltage of the reset voltage terminal to the first electrode of the light-emitting element, and the first scan signal terminal is configured to control the second reset module to be turned on and apply the reset voltage to the gate of the driving transistor;

wherein in a data write stage of the pixel driving circuit, the reset control circuit is configured to control the first reset module to be turned on and apply the reset voltage to the first electrode of the light-emitting element, and the second scan signal terminal is configured to control the data write module to be turned on and write a data signal of the data signal terminal to the gate of the driving transistor;

wherein the reset control circuit comprises a first reset control module and a second reset control module, a first terminal of the first reset control module is electrically connected to a first voltage signal terminal, and a second terminal of the first reset control module is electrically connected to the output terminal of the reset control circuit to control the first reset module to be turned on, a first terminal of the second reset control module is electrically connected to a second voltage signal terminal, and a second terminal of the second reset control module is electrically connected to the output terminal of the reset control circuit to control the first reset module to be turned off; and wherein the first reset control module comprises a first switch transistor and a second switch transistor, or comprises a second resistor, and the second reset control module comprises a first resistor or a third switch transistor.

2. The display panel according to claim 1, wherein in a case where the first reset control module comprises the first switch transistor and the second switch transistor, a gate of the first switch transistor is electrically connected to the first scan signal terminal, a first electrode of the first switch transistor is electrically connected to the first voltage signal terminal, and a second electrode of the first switch transistor is electrically connected to the output terminal of the reset control circuit; and a gate of the second switch transistor is electrically connected to the second scan signal terminal, a first electrode of the second switch transistor is electrically connected to the first voltage signal terminal, and a second electrode of the second switch transistor is electrically connected to the output terminal of the reset control circuit.

3. The display panel according to claim 1, wherein, in a stage between the initial reset stage and the data write stage, the second reset control module is configured to control the first reset module to be turned off.

4. The display panel according to claim 3, wherein in a case where the second reset control module comprises the first resistor, a first terminal of the first resistor is electrically connected to the second voltage signal terminal, and a second terminal of the first resistor is electrically connected to the output terminal of the reset control circuit.

5. The display panel according to claim 1, wherein in a case where the second reset control module comprises the third switch transistor, a gate of the third switch transistor is electrically connected to the light emission signal terminal, a first electrode of the third switch transistor is electrically connected to the second voltage signal terminal, and a second electrode of the third switch transistor is electrically connected to the output terminal of the reset control circuit.

6. The display panel according to claim 1, wherein, in a stage between the initial reset stage and the data write stage, the second reset control module is configured to control the first reset module to be turned on.

7. The display panel according to claim 6, wherein in a case where the first reset control module comprises the second resistor, a first terminal of the second resistor is electrically connected to the first voltage signal terminal, and a second terminal of the second resistor is electrically connected to the output terminal of the reset control circuit.

8. The display panel according to claim 7, wherein the first reset control module further comprises a first switch transistor or a second switch transistor, a gate of the first switch transistor is electrically connected to the first scan signal terminal, a first electrode of the first switch transistor is electrically connected to the first voltage signal terminal, and a second electrode of the first switch transistor is electrically connected to the output terminal of the reset control circuit; and a gate of the second switch transistor is electrically connected to the second scan signal terminal, a first electrode of the second switch transistor is electrically connected to the first voltage signal terminal, and a second electrode of the second switch transistor is electrically connected to the output terminal of the reset control circuit.

9. The display panel according to claim 1, comprising a display region and a bezel region, wherein the bezel region is located at periphery of the display region;

the pixel driving circuit is located in the display region, and the reset control circuit is located in the bezel region; and a plurality of pixel driving circuits in a same row share a same reset control circuit.

10. The display panel according to claim 1, wherein a gate of the first transistor is electrically connected to the output terminal of the reset control circuit, a first electrode of the first transistor is electrically connected to the reset voltage terminal, and a second electrode of the first transistor is electrically connected to the first electrode of the light-emitting element.

11. The display panel according to claim 1, wherein the pixel driving circuit further comprises a threshold compensation module and a retention module, the threshold compensation module comprises a fourth transistor and the retention module comprises a storage capacitor, a control terminal of the threshold compensation module is electrically connected to the second scan signal terminal, a first terminal of the threshold compensation module is electrically connected to the gate of the driving transistor, and a second terminal of the threshold compensation module is electrically connected to the second electrode of the driving transistor; and a first terminal of the retention module is electrically connected to the second constant voltage terminal, and a second terminal of the retention module is electrically connected to the gate of the driving transistor.

12. The display panel according to claim 11, wherein a gate of the second transistor is electrically connected to the light emission signal terminal, a first electrode of the second transistor is electrically connected to the second constant voltage terminal, and a second electrode of the second transistor is electrically connected to the first electrode of the driving transistor;

a gate of the third transistor is electrically connected to the second scan signal terminal, a first electrode of the third transistor is electrically connected to the data signal terminal, and a second electrode of the third transistor is electrically connected to the first electrode of the driving transistor;

a gate of the fourth transistor is electrically connected to the second scan signal terminal, a first electrode of the fourth transistor is electrically connected to the gate of the driving transistor, and a second electrode of the fourth transistor is electrically connected to the second electrode of the driving transistor;

a gate of the fifth transistor is electrically connected to the first scan signal terminal, a first electrode of the fifth transistor is electrically connected to the reset voltage terminal, and a second electrode of the fifth transistor is electrically connected to the gate of the driving transistor;

a gate of the sixth transistor is electrically connected to the light emission signal terminal, a first electrode of the sixth transistor is electrically connected to the second electrode of the driving transistor, and a second electrode of the sixth transistor is electrically connected to the first electrode of the light-emitting element; and a first plate of the storage capacitor is electrically connected to the second constant voltage terminal, and a second plate of the storage capacitor is electrically connected to the gate of the driving transistor.

13. The display panel according to claim 1, wherein in the initial reset stage, a first scan turn-on signal is input to the first scan signal terminal of the pixel driving circuit; and in the data write stage, a second scan turn-on signal is input to the second scan signal terminal of the pixel driving circuit.

14. A display panel, comprising a pixel driving circuit, a display region and a reset control circuit, wherein the pixel driving circuit comprises a light-emitting element, a first reset module, a first control module, a data write module, a driving transistor, a second reset module, and a second control module, wherein the first reset module comprises a first transistor, the first control module comprises a second transistor, the data write module comprises a third transistor, the second reset module comprises a fifth transistor, and the second control module comprises a sixth transistor, and wherein a control terminal of the first reset module is electrically connected to an output terminal of the reset control circuit, a first terminal of the first reset module is electrically connected to a reset voltage terminal, a second terminal of the first reset module is electrically connected to a first electrode of the light-emitting element, a second electrode of the light-emitting element is electrically connected to a first constant voltage terminal, a control terminal of the second reset module is electrically connected to a first scan signal terminal, a first terminal of the second reset module is electrically connected to the reset voltage terminal, a second terminal of the second reset module is electrically connected to a gate of the driving transistor, a control terminal of the data write module is electrically connected to a second scan signal terminal, a first terminal of the data write module is electrically connected to a data signal terminal, a second terminal of the data write module is electrically connected to a first electrode of the driving transistor, a control terminal of the first control module is electrically connected to a light emission signal terminal, a first terminal of the first control module is electrically connected to a second constant voltage terminal, a second terminal of the first control module is electrically connected to the first electrode of the driving transistor, a control terminal of the second control module is electrically connected to the light emission signal terminal, a first terminal of the second control module is electrically connected to a second electrode of the driving transistor, and a second terminal of the second control module is electrically connected to the first electrode of the light-emitting element;

wherein in an initial reset stage of the pixel driving circuit, the reset control circuit is configured to control the first reset module to be turned on and apply a reset voltage of the reset voltage terminal to the first electrode of the light-emitting element, and the first scan signal terminal is configured to control the second reset module to be turned on and apply the reset voltage to the gate of the driving transistor;

wherein in a data write stage of the pixel driving circuit, the reset control circuit is configured to control the first reset module to be turned on and apply the reset voltage to the first electrode of the light-emitting element, and the second scan signal terminal is configured to control the data write module to be turned on and write a data signal of the data signal terminal to the gate of the driving transistor; and wherein the pixel driving circuit and the reset control circuit are both located in the display region, and a number of pixel driving circuits is greater than or equal to a number of reset control circuits.

15. The display panel according to claim 14, wherein a plurality of pixel driving circuits in a same row share a same reset control circuit.

16. A display device, comprising a display panel, wherein the display panel comprises a pixel driving circuit and a reset control circuit, wherein the pixel driving circuit comprises a light-emitting element, a first reset module, a first control module, a data write module, a driving transistor, a second reset module, and a second control module, wherein the first reset module comprises a first transistor, the first control module comprises a second transistor, the data write module comprises a third transistor, the second reset module comprises a fifth transistor, and the second control module comprises a sixth transistor, and wherein a control terminal of the first reset module is electrically connected to an output terminal of the reset control circuit, a first terminal of the first reset module is electrically connected to a reset voltage terminal, a second terminal of the first reset module is electrically connected to a first electrode of the light-emitting element, a second electrode of the light-emitting element is electrically connected to a first constant voltage terminal, a control terminal of the second reset module is electrically connected to a first scan signal terminal, a first terminal of the second reset module is electrically connected to the reset voltage terminal, a second terminal of the second reset module is electrically connected to a gate of the driving transistor, a control terminal of the data write module is electrically connected to a second scan signal terminal, a first terminal of the data write module is electrically connected to a data signal terminal, a second terminal of the data write module is electrically connected to a first electrode of the driving transistor, a control terminal of the first control module is electrically connected to a light emission signal terminal, a first terminal of the first control module is electrically connected to a second constant voltage terminal, a second terminal of the first control module is electrically connected to the first electrode of the driving transistor, a control terminal of the second control module is electrically connected to the light emission signal terminal, a first terminal of the second control module is electrically connected to a second electrode of the driving transistor, and a second terminal of the second control module is electrically connected to the first electrode of the light-emitting element;

wherein in an initial reset stage of the pixel driving circuit, the reset control circuit is configured to control the first reset module to be turned on and apply a reset voltage of the reset voltage terminal to the first electrode of the light-emitting element, and the first scan signal terminal is configured to control the second reset module to be turned on and apply the reset voltage to the gate of the driving transistor;

wherein in a data write stage of the pixel driving circuit, the reset control circuit is configured to control the first reset module to be turned on and apply the reset voltage to the first electrode of the light-emitting element, and the second scan signal terminal is configured to control the data write module to be turned on and write a data signal of the data signal terminal to the gate of the driving transistor;

wherein the reset control circuit comprises a first reset control module and a second reset control module, a first terminal of the first reset control module is electrically connected to a first voltage signal terminal, and a second terminal of the first reset control module is electrically connected to the output terminal of the reset control circuit to control the first reset module to be turned on, a first terminal of the second reset control module is electrically connected to a second voltage signal terminal, and a second terminal of the second reset control module is electrically connected to the output terminal of the reset control circuit to control the first reset module to be turned off; and wherein the first reset control module comprises a first switch transistor and a second switch transistor, or comprises a second resistor, and the second reset control module comprises a first resistor or a third switch transistor.

17. The display device according to claim 16, wherein in a case where the first reset control module comprises the first switch transistor and the second switch transistor, a gate of the first switch transistor is electrically connected to the first scan signal terminal, a first electrode of the first switch transistor is electrically connected to the first voltage signal terminal, and a second electrode of the first switch transistor is electrically connected to the output terminal of the reset control circuit; and a gate of the second switch transistor is electrically connected to the second scan signal terminal, a first electrode of the second switch transistor is electrically connected to the first voltage signal terminal, and a second electrode of the second switch transistor is electrically connected to the output terminal of the reset control circuit.

18. The display device according to claim 16, wherein, in a stage between the initial reset stage and the data write stage, the second reset control module is configured to control the first reset module to be turned off.

* * * * *